US005979951A

United States Patent [19]

Shimura

[11] Patent Number: 5,979,951

[45] Date of Patent: Nov. 9, 1999

[54] AUTOMOTIVE SLIDE DOOR LOCK

[75] Inventor: Ryoji Shimura, Yokohama, Japan

[73] Assignee: Ohi Seisakusho Co., Ltd., Yokohama, Japan

[21] Appl. No.: 09/048,032

[22] Filed: Mar. 26, 1998

[30] Foreign Application Priority Data

Mar. 28, 1997 [JP] Japan ..... 9-076816

[51] Int. Cl.[6] ..... E05C 3/06

[52] U.S. Cl. ..... 292/216; 292/DIG. 23; 292/DIG. 46

[58] Field of Search ..... 292/216, 201, 292/48, 47, 53, 56, DIG. 46, DIG. 23, 226, 210, 336, DIG. 3, DIG. 26

[56] References Cited

U.S. PATENT DOCUMENTS

| | | | |
|---|---|---|---|
| 3,695,662 | 10/1972 | Ploughman | 292/216 |
| 4,440,006 | 4/1984 | Kleefeldt | 70/264 |
| 4,662,109 | 5/1987 | Yui et al. | 49/214 |
| 4,783,102 | 11/1988 | Bernard | 292/216 |
| 4,917,420 | 4/1990 | Rogers, Jr. | 292/198 |
| 4,978,153 | 12/1990 | Hirsch et al. | 292/201 |
| 5,188,406 | 2/1993 | Sterzenbach et al. | 292/216 |
| 5,234,237 | 8/1993 | Gergoe et al. | 292/201 |
| 5,238,274 | 8/1993 | Becker et al. | 292/201 |
| 5,273,324 | 12/1993 | Kobayashi | 292/201 |
| 5,308,130 | 5/1994 | Lee | 292/336.3 |
| 5,605,363 | 2/1997 | Kapes | 292/196 |
| 5,613,716 | 3/1997 | Cafferty | 292/216 |
| 5,718,465 | 2/1998 | Dowling et al. | 292/216 |

*Primary Examiner*—Steven Meyers
*Assistant Examiner*—Clifford B Vaterlaus
*Attorney, Agent, or Firm*—Foley & Lardner

[57] ABSTRACT

A latch plate pivots between a latch position wherein the latch plate engages with the striker and an open position wherein the latch plate releases the striker. A pawl member pivots between an engaging position wherein the pawl member engages with the latch plate to restrain the latch plate in the latch position and a releasing position wherein the pawl member disengages from the latch plate. A holding lever pivots while incorporating with the latch plate and the pawl member. The holding lever includes a holding portion which is engageable with the pawl member to restrain the pawl member in the releasing position and an arm portion against which a projected part of the latch plate abuts to pivot the holding lever in a direction to disengage the holding portion from the pawl member when the latch plate is pivoted from the latch position toward the open position.

8 Claims, 5 Drawing Sheets

AUTOMOTIVE SLIDE DOOR LOCK

BACKGROUND OF THE INVENTION

1. Field of the Invention

The present invention relates in general to door locks, and more particularly to automotive slide door locks of a type which comprise a latch plate engageable with a striker to achieve a latched condition of the slide door and a pawl member engageable with the latch plate to keep the latched condition of the slide door. More specifically, the present invention is concerned with a door lock used as an auxiliary door lock in a slide door dual lock system which employs two door locks to latch the slide door to a door opening.

2. Description of the Prior Art

Among various locks for automotive slide doors, there is a dual lock system which includes main and auxiliary door locks which are mounted to rear and front portions of the slide door. Upon closing of the slide door, the main and auxiliary door locks latch the rear and front portions of the door to the vehicle body. Usually, the front or auxiliary door lock is employed for tightly restraining the latched door even upon a vehicle collision. For the functions of these two door locks, a door opening of the vehicle body is equipped with rear and front strikers to which respective latch plates of the main and auxiliary door locks are engageable.

Each of the main and auxiliary door locks is constructed to have three conditions, which are a full-latch condition wherein the latch plate fully latches the striker with an aid of pawl member to completely latch the door at the closed position, a half-latch condition wherein the latch plate incompletely latches the striker with an aid of the pawl member to incompletely latch the door at the closed position and an open condition wherein the latch plate is released from the pawl member to release the striker thereby to release the door.

In case of an auto-slide door wherein initial opening motion and subsequent opening movement of the door are carried out by an electric power, an electric actuator is used for actuating both the main and auxiliary door locks. In this case, a link member is used which extends from the electric actuator to both the main and auxiliary door locks. When, for the purpose of opening the slide door, an operator (or driver) operates a so-called "open switch" ON, the electric actuator is energized to move the link member in a direction to cancel the latched condition of the latch plate of each door lock. Usually, the link member is connected to both the inside and outside door handles, so that the two door locks can be actuated by the door handles.

Due to the nature of the slide door, when the door is slid into the door opening, the latching action of the auxiliary door lock to the front striker is completed before that of the main door lock to the rear striker. That is, when the slide door is about to be led into the door opening, the door is inclined relative to the door opening having the front or auxiliary door lock positioned close to the front striker and the rear or main door lock positioned away from the rear striker. Thus, further movement of the slide door into the door opening induces firstly the engagement of the auxiliary door lock with the front striker and then the engagement of the main door lock with the rear striker. In fact, until the main door lock completes its full-latch condition, the auxiliary door lock is compelled to assume a so-called "over-stroke condition" wherein the latch plate is overly turned beyond its full-latch position. When the slide door is finally and thus neatly put into the door opening, the auxiliary door lock is turned back to the normal full-latch condition. That is, due to the nature of the slide door, the two door locks are compelled to operate with different timings.

Such different timing operation of the two door locks tends to induce the following disadvantage at the time of opening the slide door.

That is, when, due to ON turning of the open switch, the electric actuator is energized to move the link member in the latch canceling direction, the latch plates of both the main and auxiliary door locks are released from respective pawl members and the main door lock is instantly turned to its open condition. However, the auxiliary door lock can not be turned to its open condition until the slide door makes a certain open motion from the closed position. That is, during this time, the auxiliary door lock is kept in the above-mentioned "over-stroke condition". This means that it is necessary to keep the electric actuator energized for a certain time even after completion of turning of the main door lock to its open position. If the energization is stopped just after turning of the main door lock to the open position, the auxiliary door lock is turned back to its full-latch (or half-latch) condition. Of course, in this case, the slide door can not be opened. In practice, in order to suppress this undesired phenomenon, an elongate electric connector unit has been hitherto employed for keeping the electric connection between the electric actuator installed in the slide door and a power source installed in the vehicle body.

SUMMARY OF THE INVENTION

It is therefore an object of the present invention to provide a door lock which can be used as an auxiliary door lock of a slide door dual lock system, which door lock is free of the above-mentioned drawbacks.

It is another object of the present invention to provide a dual lock system of an automotive slide door, which employs therein the door lock of the invention.

According to a first aspect of the present invention, there is provided an automotive slide door lock for use with a striker. The automotive slide door lock comprises a latch plate which pivots about a first shaft between a latch position wherein the latch plate engages with the striker and an open position wherein the latch plate releases the striker; a pawl member which pivots about a second shaft between an engaging position wherein the pawl member engages with the latch plate to restrain the latch plate in the latch position and a releasing position wherein the pawl member disengages from the latch plate; and a holding lever which pivots about a third shaft, the holder lever including a holding portion which is engageable with the pawl member to restrain the pawl member in the releasing position and an arm portion against which a part of the latch plate abuts to pivot the holding lever in a direction to disengage the holding portion from the pawl member when the latch plate is pivoted from the latch is position toward the open position.

According to a second aspect of the present invention, there is provided a dual lock system for locking a slide door to a door opening of a vehicle body. The dual lock system comprises front and rear strikers mounted to front and rear portions of the door opening; main and auxiliary door locks mounted to rear and front portions of the slide door to establish a latched engagement with the rear and front strikers when the slide door is fully received in the door opening; an actuating means; and a link member extending from the actuating means to respective inlet means of the main and auxiliary door locks to move the inlet means in a given direction when the actuating means is operated;

wherein the auxiliary door lock is equipped with a mechanism through which open condition of the auxiliary door lock is instantly obtained upon movement of the inlet means in the given direction and through which the open condition is maintained even when the inlet means is moved in a direction opposite to the given direction.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 8:
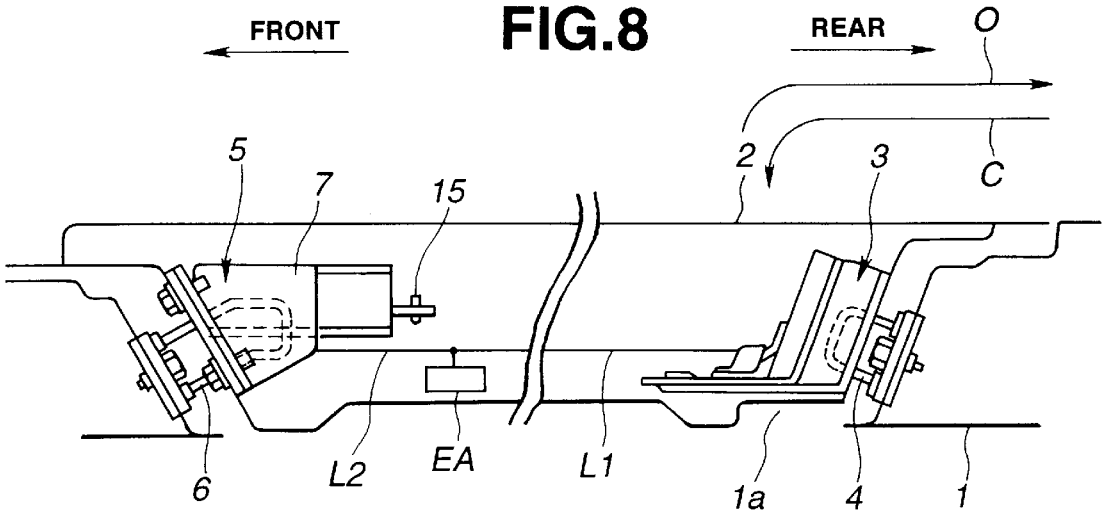
FIG. 8 is a horizontally sectional view of an automotive slide door at a portion where main and auxiliary door locks are arranged, the door assuming its fully closed latched position.

Referring to FIG. 8, there is shown a horizontally sectional view of an automotive slide door 2 at a portion where the main and auxiliary door locks 3 and 5 are mounted. The slide door 2 is shown to assume its fully closed and latched position.

In the drawing, denoted by numeral 1 is a side wall of a motor vehicle body. The slide door 2 is arranged to slide forward and rearward along the side wall 1. Denoted by numeral 1*a* is a door opening formed in the side wall 1.

Although not shown in the drawing, a guide rail structure is mounted to the side wall 1 for guiding the opening and closing movement of the slide door 2. These opening and closing movements are indicated by arrows "O" and "C" respectively. As is understood from these arrows "O" and "C", for opening the slide door 2 in the closed position, an initial movement is necessary to shift the slide door 2 laterally outward, and for closing the slide door 2, a final movement is necessary to shift the slide door laterally inward.

Denoted by numeral 3 is a main door lock mounted to a rear part of the slide door 2, which is engageable with a rear striker 4 fixed to a rear part of the door opening 1*a*. Denoted by numeral 5 is an auxiliary door lock mounted to a front part of the slide door 2, which is engageable with a front striker 6 fixed to a front part of the door opening 1*a*.

An electric actuator EA is mounted in the door 2, from which link members L1 and L2 extend to the main and auxiliary door locks 3 and 5. Although not shown the in the drawing, these link members L1 and L2 are connected to the inside and outside door handles in conventional manner.

The main door lock 3 comprises a latch plate engageable with the rear striker 4 and a pawl member engageable with the latch plate. The latch plate has three positions, which are a full-latch position wherein the latch plate completely latches the rear striker 4 with an aid of the pawl member, a half-latch position wherein the latch plate incompletely latches the rear striker 4 with an aid of the pawl member and an open position wherein the latch plate is released from the pawl member to release the rear striker 4. In the illustrated condition of the door 2, both the main and auxiliary door locks 3 and 5 assume their full-latch conditions completely latching the respective strikers 4 and 6.

Figure 1:
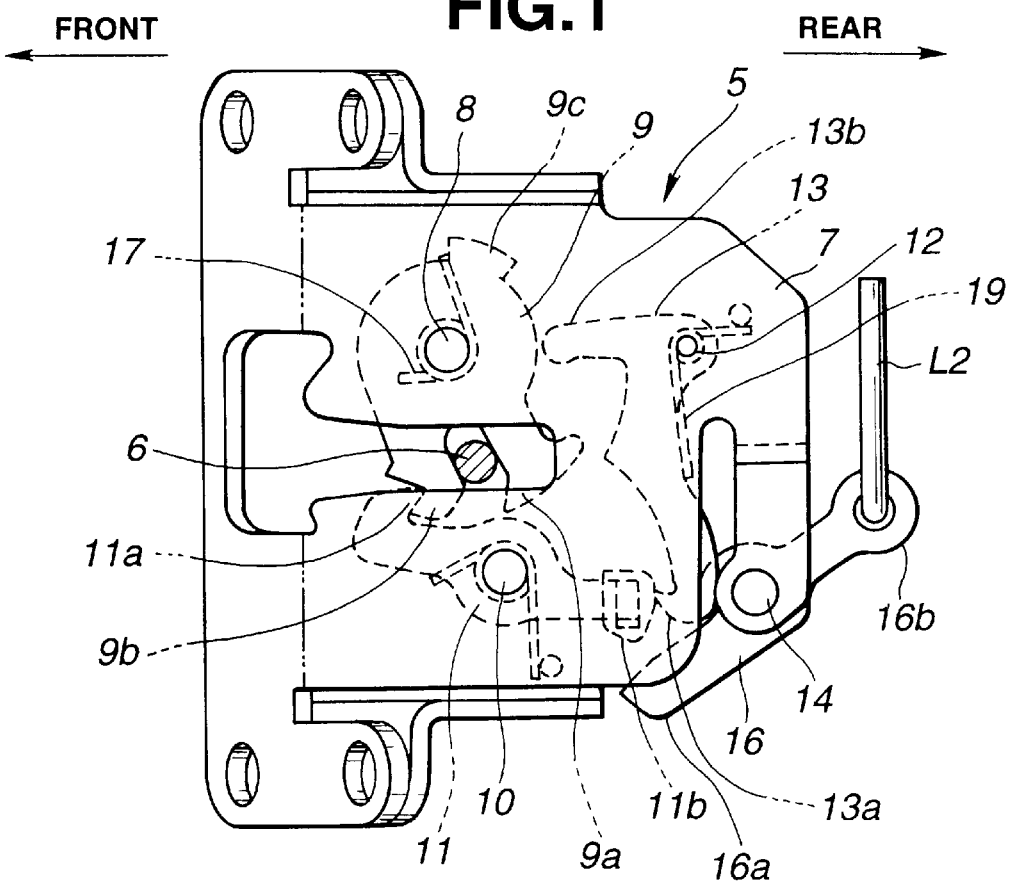
FIG. 1 is a front view of an auxiliary door lock according to the present invention.

As is well shown in FIG. 1, the auxiliary door lock 5 comprises a housing 7 which is fixed to the front part of the slide door 2.

Within the housing 7, there is installed a latch plate 9 which pivots about a shaft 8. The latch plate 9 comprises a half-latch engaging part 9*a*, a full-latch engaging part 9*b* and a releasing part 9*c*. As shown, the two engaging parts 9*a* and 9*b* define therebetween a recess into which the front striker 6 is insertable. The releasing part 9*c* is a projected part provided at an opposite side of the recess relative to the shaft 8.

Within the housing 7, there is installed a pawl member 11 which pivots about a shaft 10. The pawl member 11 comprises a pawl portion 11*a* which is selectively engageable with the half-latch and full-latch engaging parts 9*a* and 9*b* of the latch plate 9, and an engaging portion 11*b* which is bent normally in a direction of the thickness of the pawl member 11.

Within the housing 7, there is further installed a holding lever 13 which pivots about a shaft 12. The holding lever 13 comprises a hook-shaped holding portion 13*a* engageable with the engaging portion 11*b* of the pawl member 11, and an arm portion 13*b* engageable with the projected releasing part 9*c* of the latch plate 9.

Figure 2:
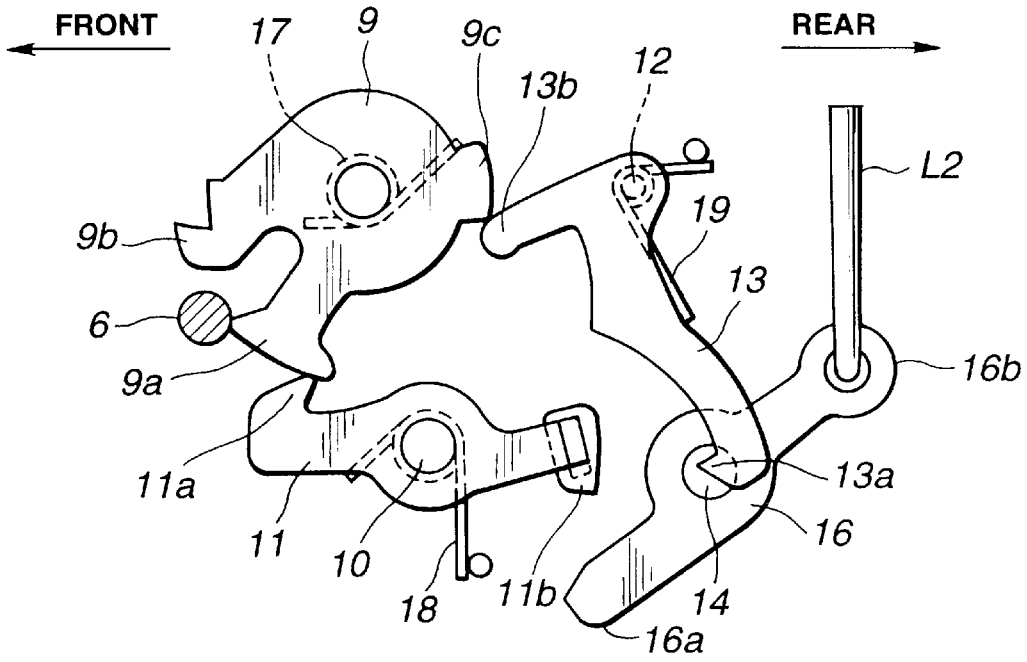
FIG. 2 is a schematic view of the auxiliary door lock in a condition wherein a latch plate assumes its open position.
Figure 3:
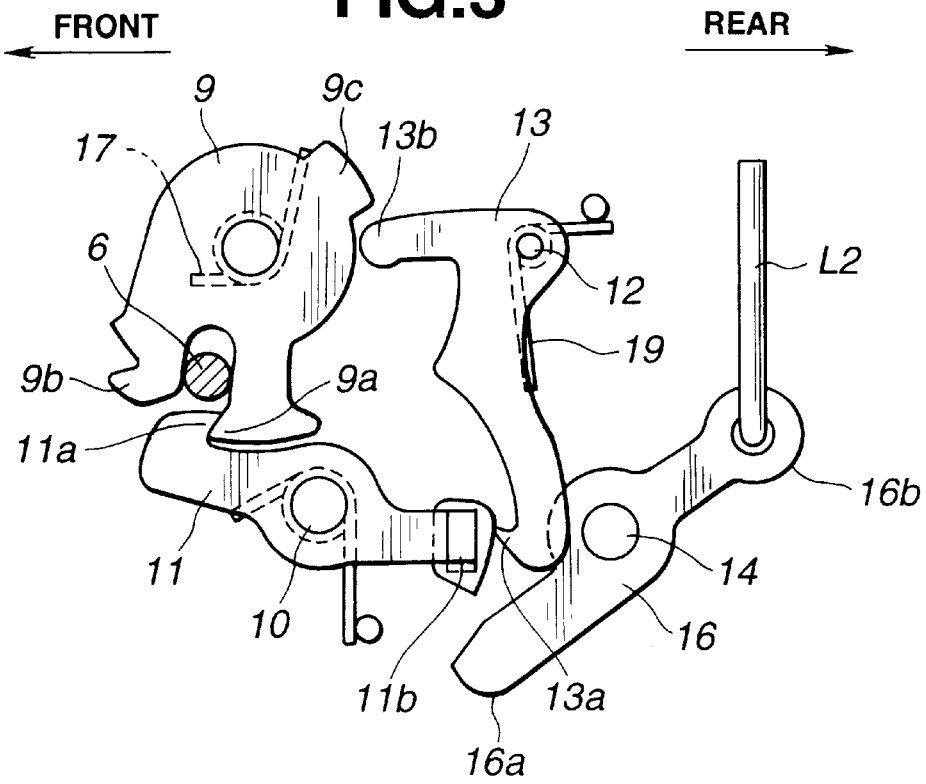
FIG. 3 is a view similar to FIG. 2, but showing a half-latch position of the latch plate.

To the housing 7, there is connected an open lever 16 which pivots about a shaft 14. The open lever 16 comprises an opening portion 16*a* engageable with an edge portion of the pawl member 11, and a connecting portion 16*b* to which the link member L2 extending from the electric actuator EA is pivotally connected. The latch plate 9 has three positions, which are an open position wherein as shown in FIG. 2, the latch plate 9 releases the striker 6, a half-latch position wherein as shown in FIG. 3, the latch plate 9 is incompletely engaged with the striker 6 having the half-latch engaging part 9*a* thereof engaged with the pawl portion 11*a* of the pawl member 11 and a full-latch position wherein as shown in FIG. 1, the latch plate 9 is completely engaged with the striker 6 having the full-latch engaging part 9*b* thereof engaged with the pawl portion 11*a* of the pawl member 11. When the latch plate 9 assumes the open position, the front portion of the slide door 2 is permitted to move in the door opening direction. When the latch plate 9 assumes the half-latch position, the front portion of the slide door 2 assumes a half-latched condition, and when the latch plate 9 assumes the full-latch position, the front portion of the door 2 assumes a full-latched condition.

Figure 5:
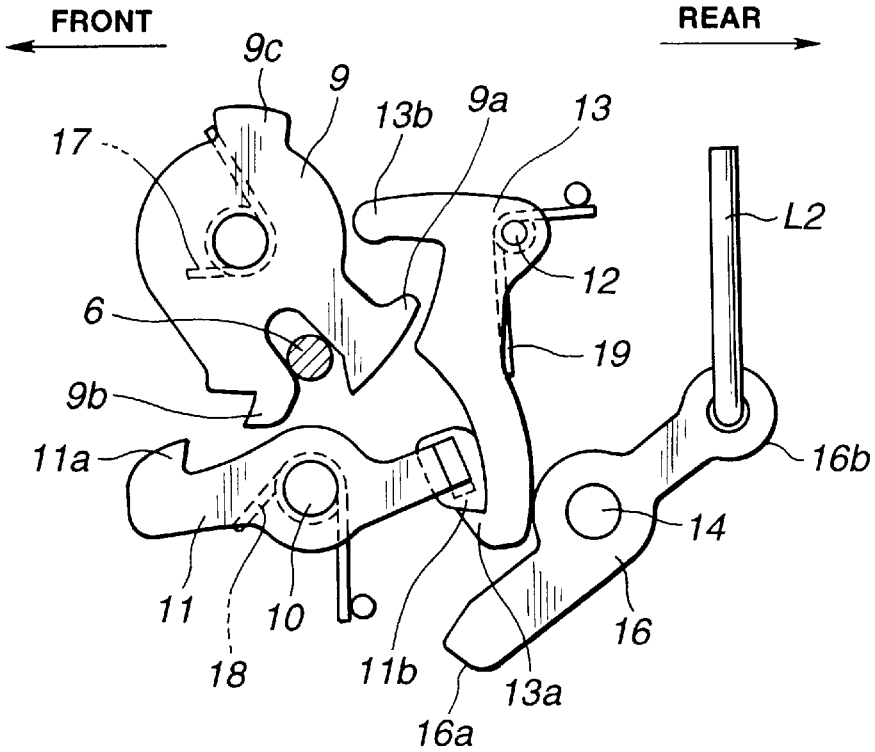
FIG. 5 is a view similar to FIG. 2, but showing a condition wherein a holding lever assumes its holding position to hold the pawl member in the releasing position.
Figure 6:
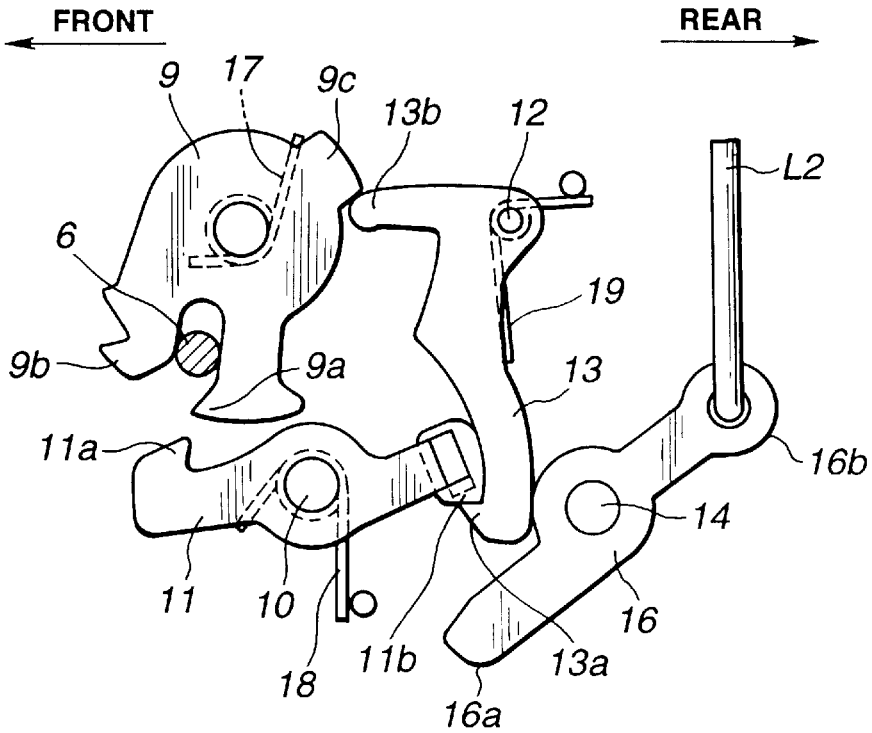
FIG. 6 is a view similar to FIG. 5, but showing a condition wherein a projected releasing part of the latch plate abuts against an arm portion of the holding lever.

The holding lever 13 has two positions, which are a holding position wherein as shown in FIGS. 5 and 6, the hook-shaped holding portion 13*a* thereof is engaged with the engaging portion 11*b* of the pawl member 11 to hold the pawl member 11 in a release position releasing the half-latch and full-latch engaging parts 9*a* and 9*b* of the latch plate 9, and a disengaging position wherein as shown in FIG. 1 or 2, the hook-shaped holding portion 13*a* thereof is disengaged or separated from the engaging portion 11*b* of the pawl member 11.

As shown in FIGS. 1 and 3, when the pawl member 11 is in its engaging position wherein the pawl portion 11*a* thereof is engaged with the full-latch or half-latch engaging part 9*b* or 9*a* of the latch plate 9, the engaging portion 11*b* of the pawl member 11 is placed in a traveling path of the hook-shaped holding portion 13*a* of the holding lever 13. Thus, under this condition, due to abutment of the hook-shaped holding portion 13*a* against a back wall of the engaging portion 11*b*, the holding lever 13 can not pivot to the holding position (viz., the position to hold the pawl member 11 in the release position).

Figure 4:
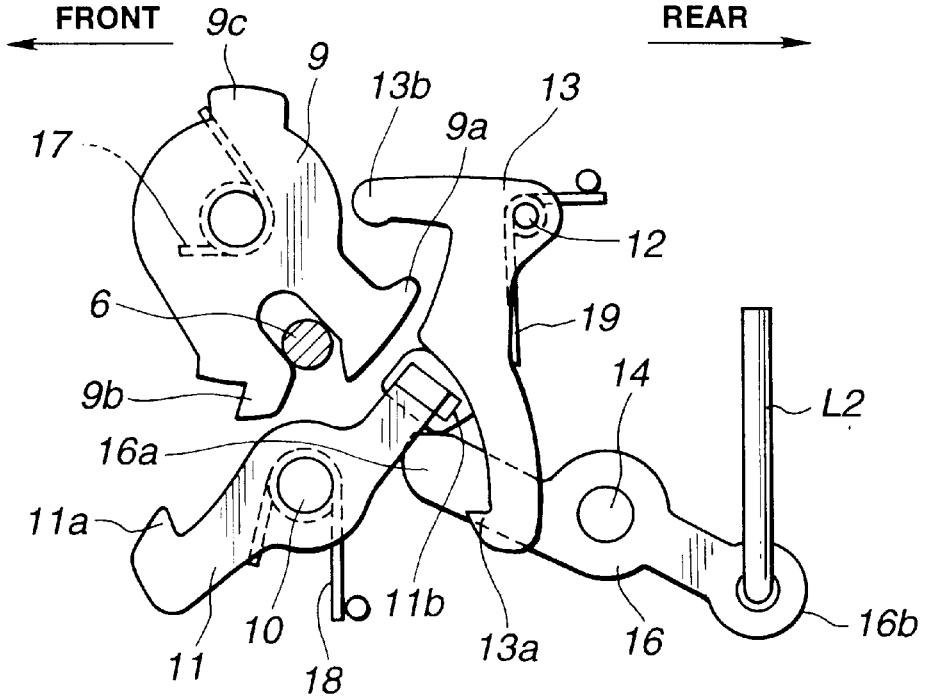
FIG. 4 is a view similar to FIG. 2, but showing a condition wherein a pawl member assumes its releasing position.

When the latch plate 9 assumes a position between the open position of FIG. 2 and the half-latch position of FIG. 3, the projected releasing part 9*c* of the latch plate 9 abuts against the arm portion 13*b* of the holding lever 13 thereby to pivot the holding lever 13 to the disengaging position as shown in FIG. 2. As shown in FIGS. 3 and 4, when the latch plate 9 is pivoted from the half-latch position of FIG. 3 to the full-latch position of FIG. 4, the projected releasing part 9*c* of the latch plate 9 is disengaged from the arm portion 13*b* permitting the holding lever 13 to assume the holding position.

The latch plate 9 is biased by a first spring 17 to pivot toward the open position, that is, in a clockwise direction in FIG. 2, and the pawl member 11 is biased by a second spring 18 to pivot toward the engaging position (viz., the position shown in FIG. 1 or 3), that is, in a clockwise direction in FIG. 2. The holding lever 13 is biased by a third spring 19 to pivot toward the holding position (viz., the position shown in FIG. 5 or 6), that is, in a clockwise direction in FIG. 2.

When, for opening the slide door 2, the open switch is operated ON, the link member L2 (see FIG. 1) is moved down.

In the following, operation of the auxiliary door lock 5 of the present invention will be described with reference to the drawings.

For ease of understanding, the explanation will be commenced with respect to the fully latched closed condition of the slide door 2 as shown in FIG. 8, wherein the latch plates of the main and auxiliary door locks 3 and 5 fully or completely latch the respective strikers 4 and 6.

As shown in FIG. 1, under such condition, the auxiliary door lock 5 assumes its full-latch condition. That is, the latch plate 9 assumes the full-latch position wherein the full-latch engaging part 9*b* thereof engages with the front striker 6, the pawl member 11 assumes the engaging position wherein the pawl portion 11*a* thereof engages with the full-latch engaging part 9*b*, and the holding lever 13 assumes the disengaging position wherein the hook-shaped holding portion 13*a* thereof is put on the back wall of the engaging portion 11*b* of the pawl member 11.

When now, for opening the door 2, the open switch is operated ON, the electric actuator EA is energized and thus the link members L1 and L2 (see FIG. 8) are moved in a direction to cancel the full-latched condition of the main and auxiliary door locks 3 and 5.

With the latch canceling movement of the link members L1 and L2, both the pawl member of the main door lock 3 and the pawl member 11 of the auxiliary door lock 5 are pivoted to their releasing positions releasing the corresponding latch plates 9. Upon this, due to a marked biasing force kept applied to the slide door 2 by a weather strip compressed between the slide door 2 and the vehicle body, the main door lock 3 (see FIG. 8) is forced to instantly release the rear striker 4 causing the rear portion of the slide door 2 to move slightly outward and backward along the guide rail structure. That is, upon ON operation of the open switch, the main door lock 3 is instantly brought to the open condition to release the rear striker.

Upon ON operation of the open switch, also the auxiliary door lock 5 is instantly brought to the open condition and maintains the open condition even when energization of the electric actuator is stopped.

That is, with the latch canceling downward movement of the link member L2 (see FIG. 1), the open lever 16 is pivoted clockwise in FIG. 1 causing the pawl member 11 to pivot toward the releasing position as shown in FIG. 4. Upon this, due to the force of the spring 19, the holding lever 13 is pivoted clockwise but slightly to the holding position wherein the hook-shaped holding portion 13*a* thereof is engaged with the engaging portion 11*b* of the pawl member 11, as is seen from FIG. 5. That is, the auxiliary door lock 5 has been brought to the open condition. That is, under this condition, the pawl member 11 is restrained to the releasing position and thus the latch plate 9 is freely pivotal.

Upon completion of the open condition of the auxiliary door lock 5, energization of the electric actuator EA is stopped. With this, the open lever 16 is pivoted back to its original inoperative position as is shown in FIG. 5.

Under the open condition of the auxiliary door lock 5, the latch plate 9 can be freely pivoted to the open position if a certain force is applied thereto.

When thereafter the slide door 2 is moved in the opening direction "O" (see FIG. 8) due to an electric power, the latch plate 9 is pivoted clockwise in FIG. 6 due to obstruction by the striker 6.

Figure 7:
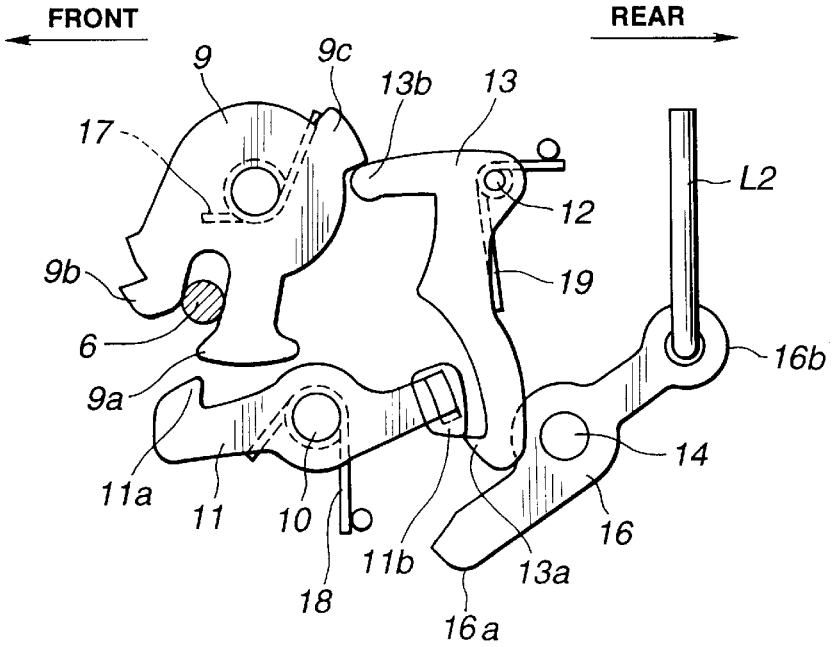
FIG. 7 is a view similar to FIG. 6, but showing a condition wherein due to abutment of the projected releasing part of the latch plate against the arm portion of the holding lever, the holding lever is about to release the pawl member.

As is seen from FIGS. 6 and 8, further opening movement "O" of the slide door 2 causes further clockwise pivoting of the latch plate 9 and thus causes the projected releasing part 9*c* of the latch plate 9 to abut against the arm portion 13*b* of the holding lever 13. Thus, further clockwise pivoting of the latch plate 9 pivots the holding lever 13 in a counterclockwise direction in FIG. 6 against the force of the spring 19 and finally as is understood from FIGS. 7 and 2, such pivoting of the latch plate 9 induces disengagement of the hook-shaped holding portion 13*a* of the holding lever 13 from the engaging portion 11*b* of the pawl member 11. Upon this, as is seen from FIG. 2, the pawl portion 11*a* of the pawl member 11 is put on an outer periphery of the half-latch engaging part 9*a* of the latch plate 6. Thus, thereafter, that is, after the latch plate 9 releases the front striker 6, the opening movement of the slide door 2 is continued keeping the auxiliary door lock 5 in the open condition as shown in FIG. 2.

When now the slide door 2 is moved in the closing direction "C", that is, forward in FIG. 8 and put into the door opening 1*a* of the side wall 1, the front striker 6 is led into the recess of the latch plate 9 (see FIG. 2) and urges the latch plate 9 to pivot counterclockwise in FIG. 2. During this, the pawl portion 11*a* of the pawl member 11 slides on the outer peripheries of the half-latch and full-latch engaging parts 9*a* and 9*b* of the latch plate 9, and the projected releasing part 9*c* of the latch plate 9 releases from the arm portion 13*b* of the holding lever 13. Thus, when the slide door 2 is fully received in the door opening 1*a*, the auxiliary door lock 5 assumes the full-latch condition as shown in FIG. 1, and the main door lock 3 assumes its full-latch condition. That is, the slide door 21 assumes its fully closed latched condition relative to the door opening 1*a*.

As is understood from the above description, in the present invention, upon ON operation of the open switch, the open condition of the auxiliary door lock 5 is instantly obtained, and the open condition is maintained even when energization of the electric actuator EA is stopped. That is, in the invention, for opening the slide door 2, there is no need of keeping energization of the electric actuator EA once the auxiliary door lock 5 is brought to the open condition of FIG. 5. In other words, once the electric actuator EA is energized due to ON operation of the open switch, the auxiliary door lock 5 is instantly brought to the open condition of FIG. 5 and the open condition is maintained throughout the opening movement of the door 2.

When now, with the slide door 2 assuming its fully closed latched condition as shown in FIG. 8, the inside or outside door handle is manipulated, the main and auxiliary door locks 3 and 5 are instantly brought to the open condition, and for the above-mentioned reasons, the open condition of the auxiliary door lock is maintained even when the inside or outside door handle is released from the operator's hand. Thus, for opening the slide door 2, there is no need of keeping the door handle gripped by the operator's hand.

Figure 9:
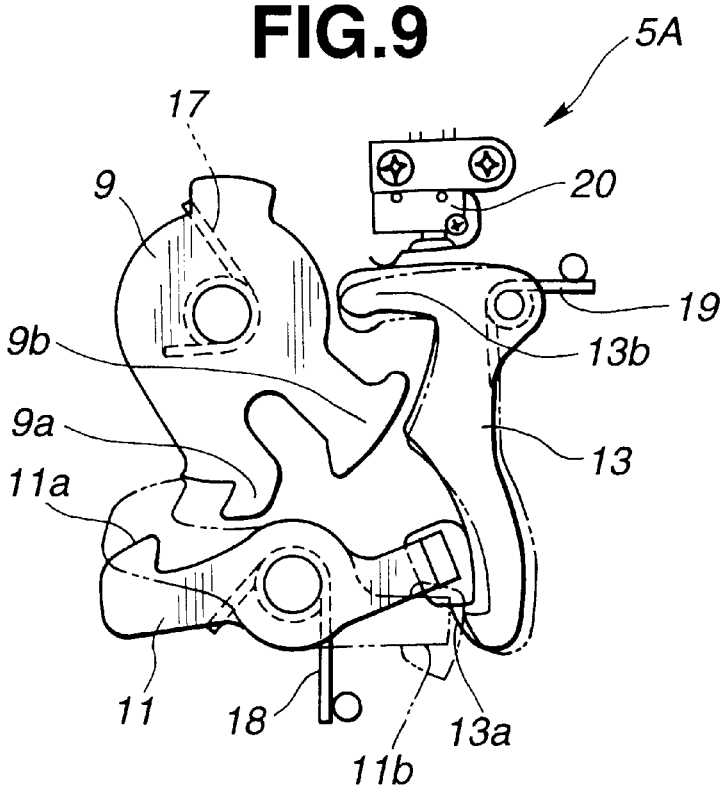
FIG. 9 is a schematic view of an auxiliary door lock which is a first modification of the auxiliary door lock of the present invention.

Referring to FIG. 9, there is shown a first modification 5A of the auxiliary door lock 5 of the invention. In this modification 5A, there is added a position detecting switch 20 which indirectly detects the releasing position of the pawl member 11. That is, when the holding lever 13 is in the holding position, a sensor arm of the switch 20 contacts the arm portion 13*b* of the holding lever 13 to cause ON condition of the switch 20. When, with the main door lock 3 assuming the half-latch or full-latch position, the position detecting switch 20 detects the releasing position of the pawl member 11, an alarm is issued for warning the operator of incomplete latch of the door 2 relative to the door opening 1*a* of the side wall 1.

Figure 10:
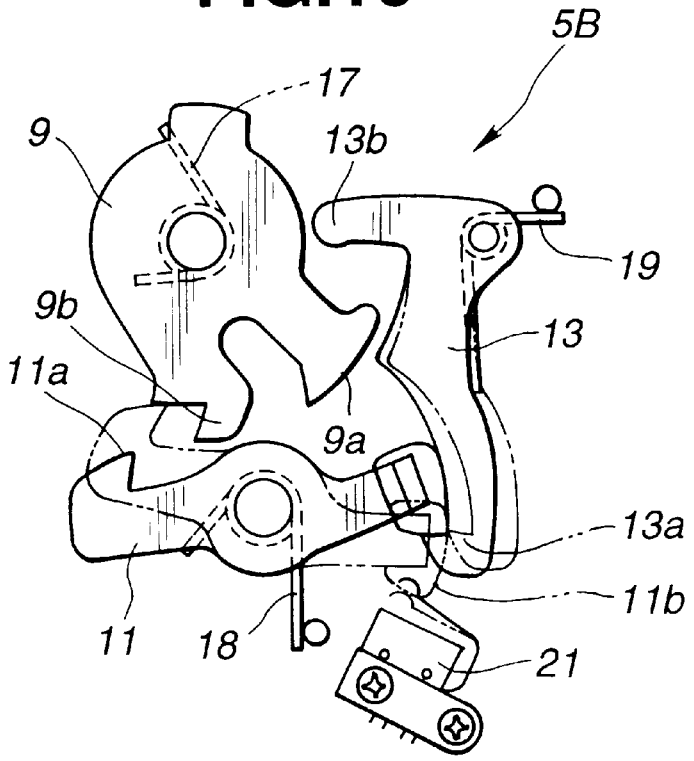
FIG. 10 is a view similar to FIG. 9, but showing a second modification of the auxiliary door lock of the present invention.

Referring to FIG. 10, there is shown a second modification 5B of the auxiliary door lock 5 of the invention. In this modification 5B, there is added a position detecting switch 21 which directly detects the releasing position of the pawl member 11. That is, when the pawl member 11 is in the releasing position, a sensor arm of the switch 21 contacts the engaging portion 11*b* of the pawl member 11 to cause ON condition of the switch 21.

What is claimed is:

1. An automotive slide door lock for use with a striker, comprising:

a latch plate which pivots about a first shaft between a latch position wherein said latch plate is adapted to engage said striker, and an open position wherein said latch plate is adapted to release said striker;

a pawl member which pivots about a second shaft between an engaging position wherein said pawl member engages with said latch plate to restrain said latch plate in said latch position, and a releasing position wherein said pawl member disengages from said latch plate;

a holding lever which pivots about a third shaft, said holding lever including a holding portion which is engageable with said pawl member to restrain said pawl member in said releasing position and an arm portion against which a part of said latch plate abuts to pivot said holding lever in a direction to disengage said holding portion from said pawl member when said latch plate is pivoted from said latch position toward said open position;

an open lever which pivots about a fourth shaft between an operative position wherein said open lever pushes said pawl member to pivot the same from said engaging position toward said releasing position, and an inoperative position wherein said open lever disengages from said pawl member; and a link member for transmitting movement of an external actuating device to said open lever.

2. An automotive slide door lock as claimed in claim 1, further comprising:

a first spring for biasing said latch plate to pivot in a direction from said latch position toward said open position;

a second spring for biasing said pawl member to pivot in a direction from said releasing position toward said engaging position; and a third spring for biasing said holding lever to pivot in a direction to achieve the engagement between said holding portion and said pawl member.

3. An automotive slide door lock as claimed in claim 1, in which said latch plate comprises:

a half-latch engaging part which establishes a half-latch condition of the door lock when engaged with said pawl member;

a full-latch engaging part which establishes a full-latch condition of the door lock when engaged with said pawl member; and a projected releasing part which constitutes said part of the latch plate.

4. An automotive slide door lock as claimed in claim 3, in which said pawl member comprises:

a pawl portion which is selectively engageable with said half-latch and full-latch engaging parts of said latch plate; and an engaging portion which is engageable with said holding portion of said holding lever; and an edge portion against which said open lever abuts when said open lever assumes said operative position.

5. An automotive slide door lock as claimed in claim 4, in which said engaging portion of said pawl member is bent in a direction of the thickness of said pawl member.

6. An automotive slide door lock as claimed in claim 4, in which said open lever comprises:

an opening portion which is engageable with said edge portion of said pawl member; and a connecting portion to which said link member is pivotally connected.

7. An automotive slide door lock as claimed in claim 1, further comprising a position detecting switch which detects the condition of said pawl member.

8. An automotive slide door lock for use with a striker, comprising:

a latch plate which pivots about a first shaft between a latch position wherein said latch plate is adapted to engage said striker, and an open position wherein said latch plate is adapted to release said striker, said latch plate being biased to pivot in a direction from said latch position toward said open position;

a pawl member which pivots about a second shaft between an engaging position wherein said pawl member engages with said latch plate to restrain said latch plate in said latch position, and a releasing position wherein said pawl member disengages from said latch plate, said pawl member being biased to pivot in a direction from said releasing position toward said engaging position;

a holding lever which pivots about a third shaft, said holding lever including a holding portion which is engageable with said pawl member to restrain said pawl member in said releasing position and an arm portion against which a part of said latch plate abuts to pivot said holding lever in a direction to disengage said holding portion from said pawl member when said latch plate is pivoted from said latch position toward said open position, said holding lever being biased to pivot in a direction to achieve the engagement between said holding portion and said pawl member;

an open lever which pivots about a fourth shaft between an operative position wherein said open lever pushes said pawl member to pivot the same from said engaging position toward said releasing position, and an inoperative position wherein said open lever disengages from said pawl member; and a link member for transmitting movement of an external actuating device to said open lever.

* * * * *